US005322427A

United States Patent [19]

Hsin-Tau

[11] Patent Number: 5,322,427

[45] Date of Patent: Jun. 21, 1994

[54] ROTARY-BLADE AIR CONDITIONER COMPRESSOR FOR HEAVY-DUTY VEHICLE

[76] Inventor: Won Hsin-Tau, No. 1-2, Lane 975, Chun-Jih Road, Toa-Yuan, Taiwan

[21] Appl. No.: 62,719

[22] Filed: May 18, 1993

[51] Int. Cl.[5] ..... F01C 21/04

[52] U.S. Cl. ..... 418/83; 418/77; 418/79; 418/268

[58] Field of Search ..... 418/267, 268, 269, 83, 418/77, 79; 184/6.16

[56] References Cited

U.S. PATENT DOCUMENTS

| | | | |
|---|---|---|---|
| 1,795,579 | 3/1931 | Storey | 48/77 |
| 1,832,614 | 11/1931 | Beckfield | 418/79 |
| 2,737,341 | 3/1956 | Bitzer | 418/79 |
| 3,291,384 | 12/1966 | Garland et al. | 418/268 |
| 4,505,653 | 3/1985 | Roberts | 418/268 |
| 4,960,371 | 10/1990 | Bassett | 418/268 |
| 4,968,233 | 11/1990 | Nakayoshi et al. | 418/77 |

FOREIGN PATENT DOCUMENTS

| | | | |
|---|---|---|---|
| 0309791 | 4/1929 | United Kingdom | 184/6.16 |

*Primary Examiner*—Richard A. Bertsch
*Assistant Examiner*—Charles G. Freay
*Attorney, Agent, or Firm*—Morton J. Rosenberg; David I. Klein

[57] ABSTRACT

A rotary blade air conditioner compressor is provided which includes a compressor housing having a cylindrical chamber. Chamber covers are mounted to respective ends of the cylindrical chamber. A reservoir is fluidly connected to an outlet and an inlet of the cylindrical chamber. A drive shaft is eccentrically mounted within the cylindrical chamber, with a rotor mounted on the drive shaft which is axially movable along the drive shaft. A plurality of radial slots are formed in the rotor which receive blade members that move radially in the slots to continuously contact the inner wall of the cylindrical chamber for expelling a mixture of gas and oil from the chamber. The gas and oil mixture comes from the reservoir and is supplied through a conduit to each end of the cylindrical chamber to axially displace the rotor with respect to the chamber covers.

1 Claim, 6 Drawing Sheets

ROTARY-BLADE AIR CONDITIONER COMPRESSOR FOR HEAVY-DUTY VEHICLE

BACKGROUND OF THE INVENTION

1. Field of the Invention

This invention relates to an air conditioning compressor, and more particularly, this invention is directed to a rotary-blade air conditioner compressor equipped with an auto balancer and lubrication recirculation system.

2. Prior Art

Compressors used in vehicles can be categorized into the following four types, 1) Reciprocating Compressors; 2) Rotary Compressors; 3) Geared Compressors; and 4) Centrifugal Compressors.

The type most frequently used in vehicle air conditioners are the reciprocating compressors, shown in FIG. 1. As the crankshaft rotates through a cycle, the piston linked thereto will complete a compression stroke and an intake stroke. The deficiency of this type of compressor is that as the piston moves to its top dead center position, there is a clearance remaining between the piston and the cylinder head. This clearance ensures that the piston will move downward freely, but it will decrease the mechanical efficiency of the compressor since the air within the clearance cannot be expelled.

Prior art rotary compressors are seldom used in vehicles, such as buses. The installation and adjustment of these rotary compressors is quite inconvenient, thereby making the installation and maintenance costs relatively high. Beside, as the bearing is worn out, the rotating shaft will tilt and then cause the whole compressor to fail.

SUMMARY OF THE INVENTION

It is an object of this invention to provide a rotary-blade air compressor which is particularly suitable for use in a heavy duty vehicle.

It is another object of this invention to provide a rotary blade air compressor wherein the rotating shaft of the compressor is incorporated with a plurality of compressing blades disposed longitudinally along the rotating shaft, such that the blades have a firm contact with the wall of the cylinder to expel all of the compressed air out of the cylinder. Therefore, the mechanical efficiency is increased, as is the cooling effect.

It is a further object of this invention is to provide a rotary blade air compressor wherein the driving shaft is incorporated with an auto-balancer which can move freely to compensate for a deviation thereof.

The structural and operational characteristics of the present invention and its advantages as compared to the known state of the prior art will be better understood from the following description, relating to the attached drawings which show illustratively but not restrictively, an example of rotary blade air compressor according to the present invention, wherein:

DESCRIPTION OF THE PREFERRED EMBODIMENT

Figure 1:
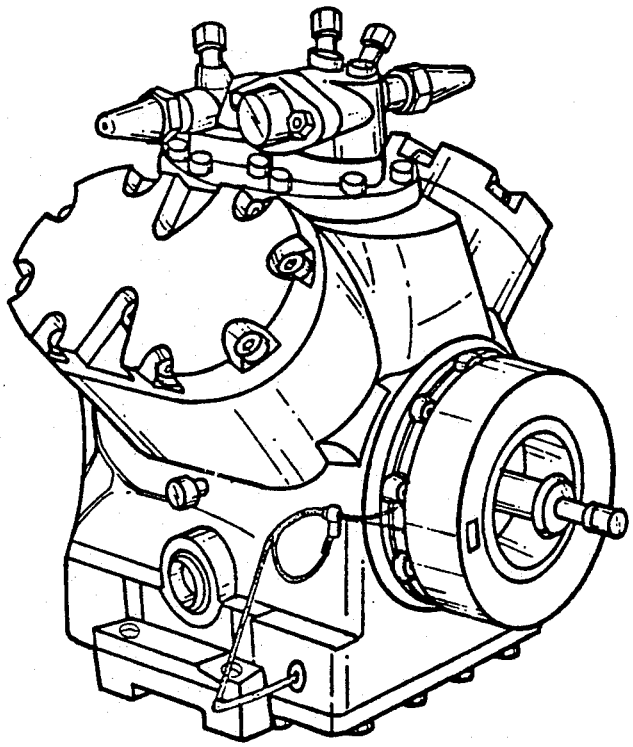
PRIOR ART FIG. 1
FIG. 1 is a perspective view of a prior art reciprocating air compressor.
Figure 2:
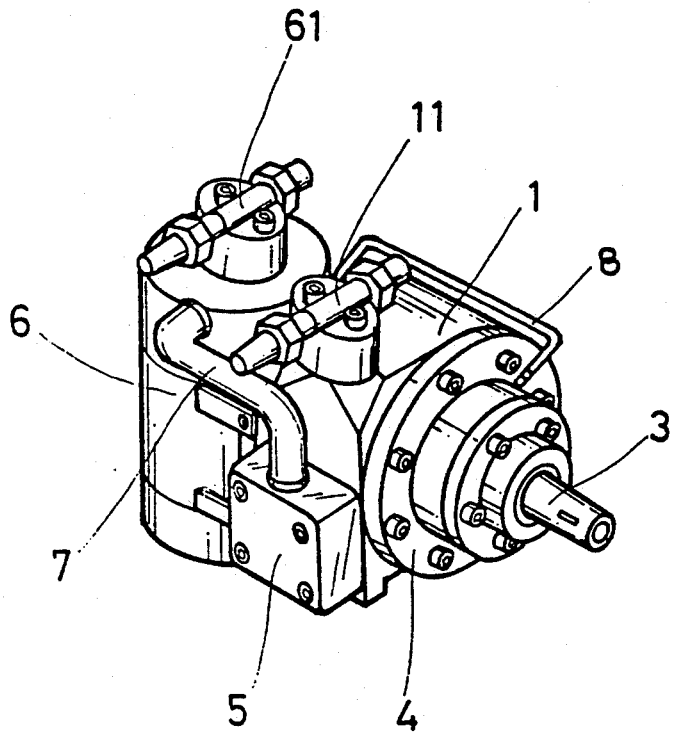
FIG. 2 is a perspective view of a rotary blade air compressor made according to this present invention.
Figure 3:
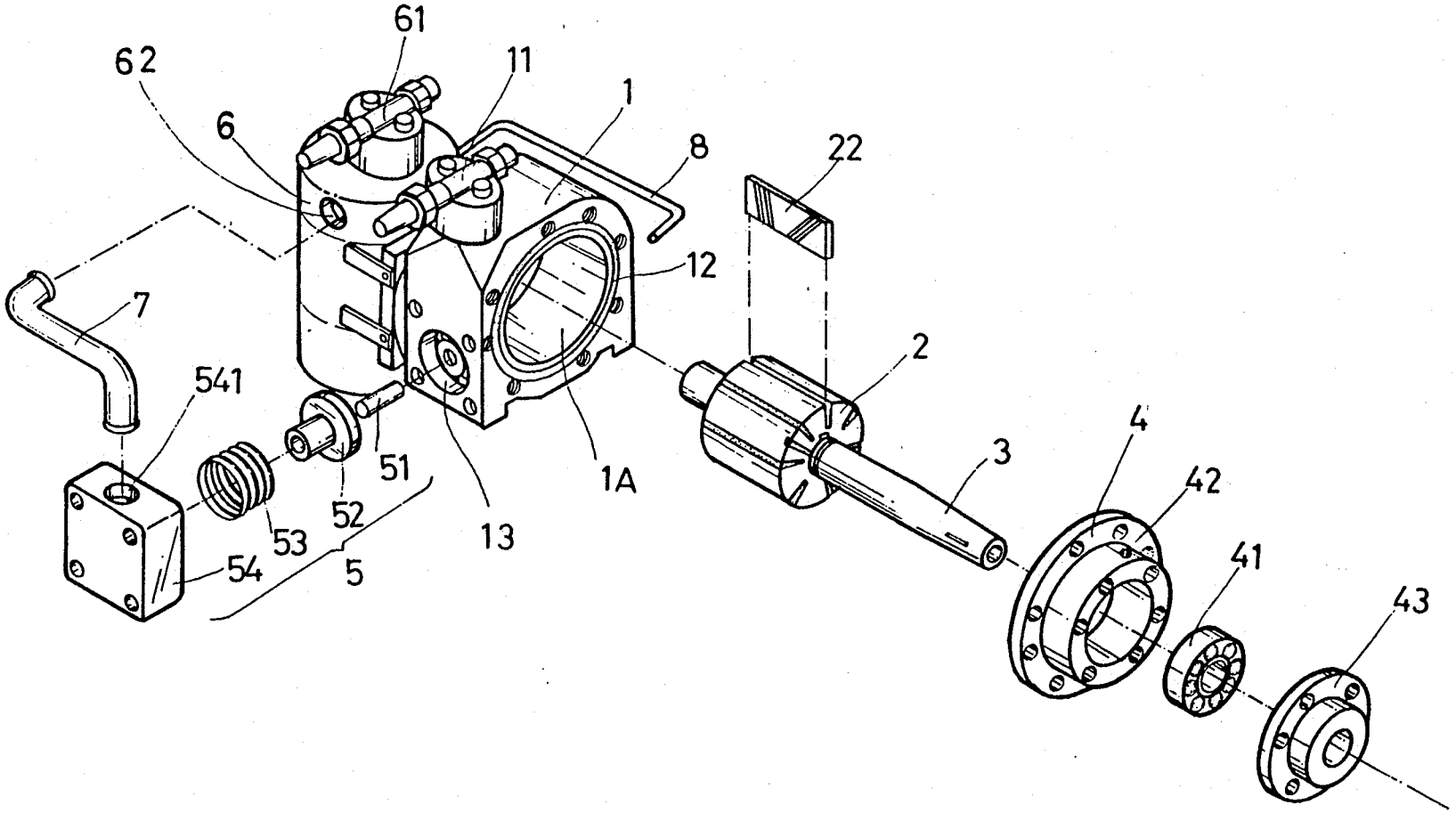
FIG. 3 is an exploded perspective view of a rotary blade air compressor made according to this present invention.
Figure 3A:
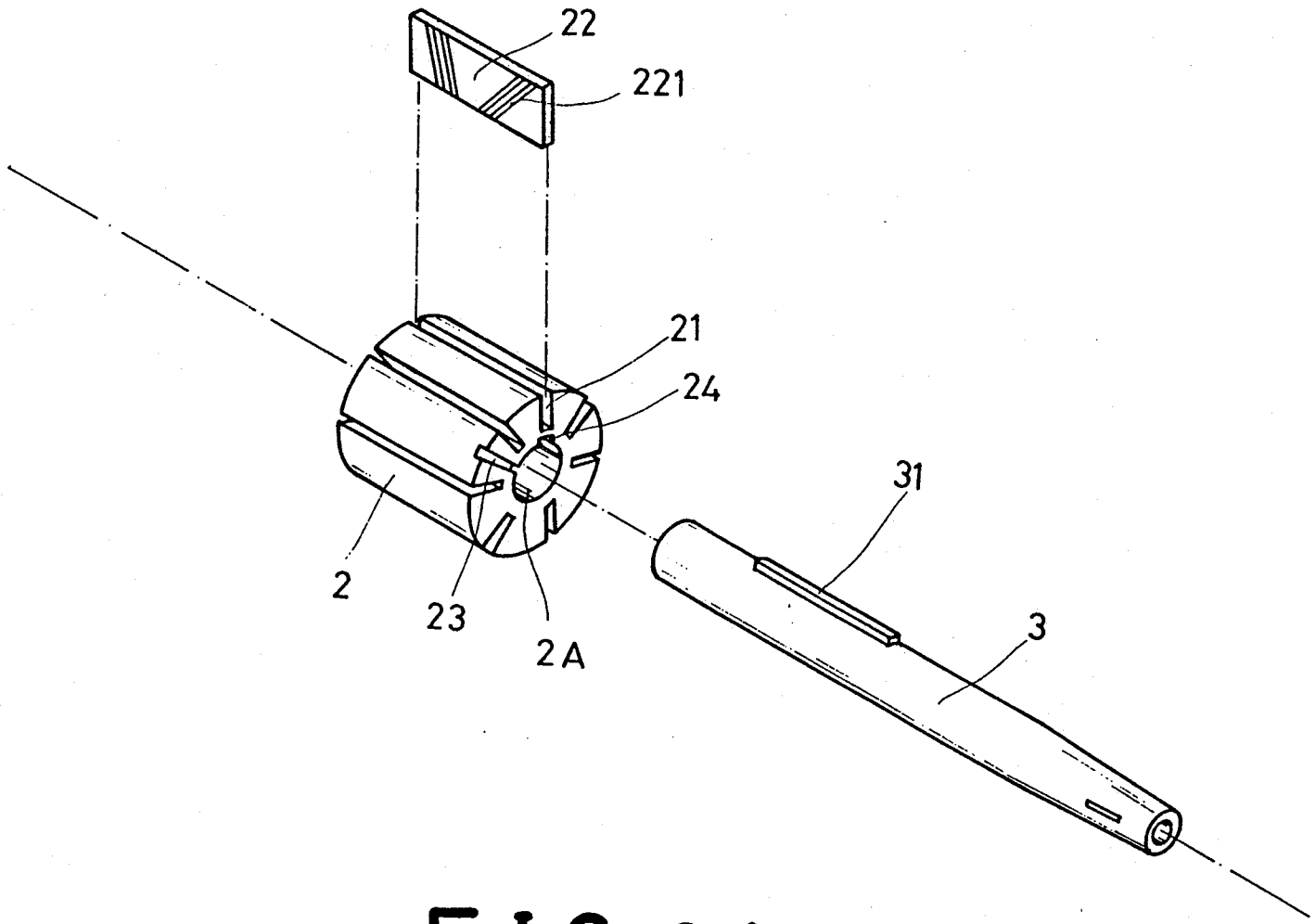
FIG. 3A is an exploded perspective view of the rotor and the drive shaft made according to this present invention.

Referring to FIGS. 2, 3 and 3A, there is shown a rotary blade air conditioner compressor including a cylinder 1 having a cylindrical chamber 1A formed therein, and a low pressure valve 11 is attached in the upper side wall of said cylinder 1 and in fluid communication with chamber 1A. An O-ring 12 is disposed in the rear and front sides respectively. An outlet 13 is formed in the front of cylinder 1 and is in fluid communication with chamber 1A.

A rotor 2 which is disposed on a driving shaft 3 includes a plurality of slots 21 formed longitudinally in the outer surface thereof. Each of the slots 21 receives a respective blade 22. The rotor 2 further includes an oil channel 23 formed on opposing rear and front longitudinal ends thereof. The rotor 2 includes a key slot 24 formed longitudinally within a centrally disposed axial through bore 2A. As is shown in the FIG. 3A, the oil channel extends from the through bore 2A to the outer surface of rotor 2, providing fluid communication between chamber 1A and bore 2A.

The driving shaft 3 has a key member 31 disposed thereon for receipt within key slot 24. The rotor 2 is slidably sleeved onto the driving shaft 3. As the driving shaft 3 rotates, the rotor 2 is rotated therewith, by virtue of the keyed coupling therebetween.

Figure 5:
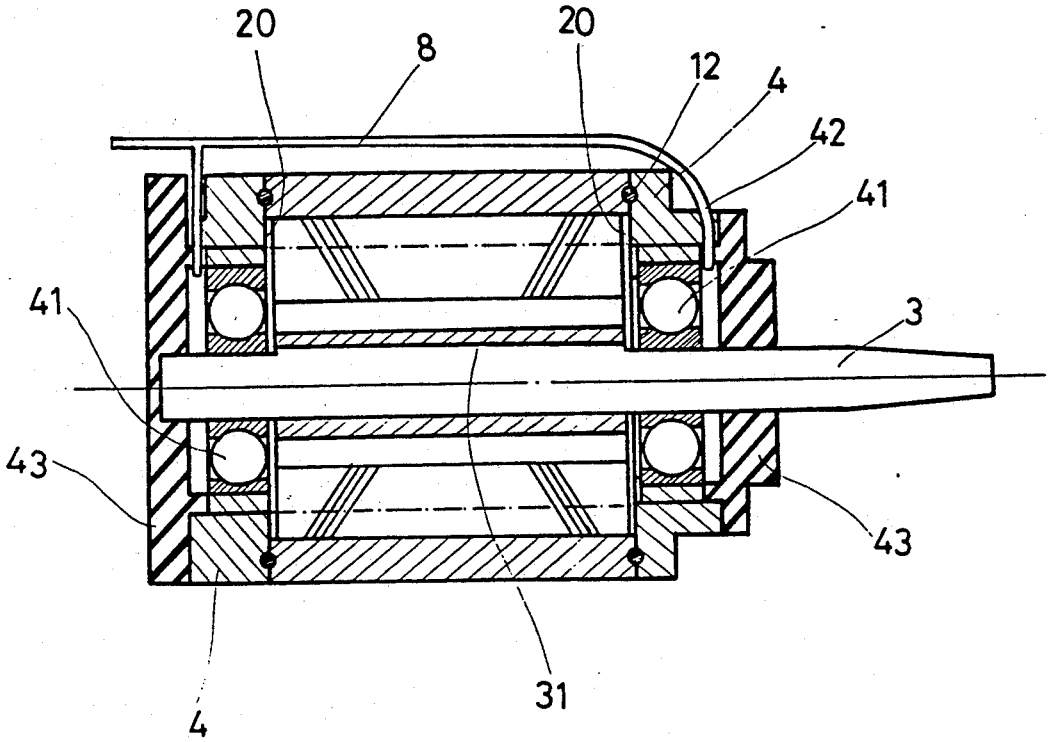

As shown in FIG. 5, a respective cylinder cover 4, having a bearing 41 received therein, is attached to each of the opposing front and rear ends of the cylinder 1. Each of the cylinder covers 4 includes an oil hole 42 formed therein for carrying lubricant to the bearing 41. The outer end of each cylinder cover 4 is closed by a cover 43.

A check valve 5 is disposed in the outlet 13 of the cylinder 1. The check valve includes a fixed shaft member 51 and a piston 52 slidably disposed thereon. The piston 52 is biased by a spring member 53. The check valve 5 further includes a cover 54 which is installed on the outlet 13 of the cylinder 1. The cover 54 has an outlet port 541 formed therein.

A reservoir 6 is coupled to the rear side of the cylinder 1. The reservoir 6 is disposed vertically with a high pressure valve 61 disposed at the top of the reservoir and an inlet 62 formed in the side thereof. A hose 7 is coupled between the outlet 541 of the check valve 5 and the inlet 62 of said reservoir 6 to provide fluid communication therebetween. A lubricating hose 8 is connected between the bottom of the reservoir 6 and the oil hole 42 of each of the cylinder covers 4 to provide fluid communication therebetween.

Each blade member 22 is made from phenolic resin which provides better durability and less resistance to displacement than that of an aluminum alloy. Each blade 22 can slide freely within a respective slot 21, and each blade 22 is further provided with a plurality of inclined grooves 221 formed therein for providing better lubricating and air-expelling effects.

A characteristic of this invention is that the rotor 2 is slidably disposed on the driving shaft 3. Hence, the rotor 2 is axially movable along the shaft 3, with the key 31 being within the key slot 24. As the driving shaft 3 rotates, the rotor 2 slides along the driving shaft 3 and achieves an auto-balancing effect.

Figure 4:
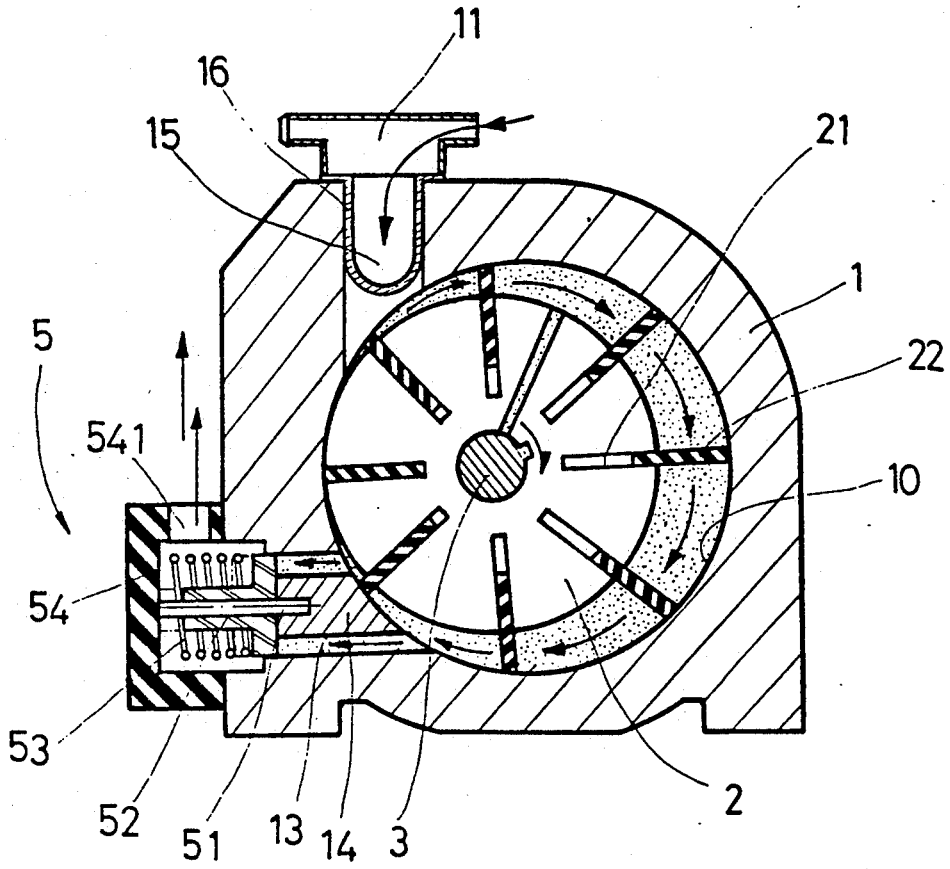
FIG. 4 is a cross-sectional view illustrating the movement of the rotary blades; and, FIG. 5 is a cross-sectional view taken along the longitudinal axis of the drive shaft.

Referring to FIG. 4, the driving shaft 3 is shown as bot being disposed in the center of the chamber 1A of the cylinder 1. As the rotor 2 rotates, the blades 22 will move outwardly from the respective slots 21 and pres against the wall 10 of the cylindrical chamber 1A. The gas supplied from the low pressure valve 11 passes through the filter 16 installed on the inlet 15, the inlet being in fluid communication with chamber 1A. The entering gas will be stirred with the lubricating oil inside the cylinder 1 by the blade 22 rotating clockwise. As the gas/oil mixture is transferred to a vapor mixture, it will be expelled from the outlet 13. The piston 52 of the check valve 5 is displaced against the spring bias face by the pressure of the fluid at the outlet 13. The mixture is thereby expelled out from the outlet 541 and directed into reservoir 6, through hose 7.

Referring to FIG. 5, the mixture of gas and lubricating oil within the reservoir 6 is directed into each of the cylinder covers 4 through the hose 8, and then flows into the cylinder 1 through each of the respective bearings 41. The rotor 2 then achieves a balance, since both opposing ends of the rotor 2 receive the mixture of gas and oil. Hence, the clearance 20 between the rotor 2 and each of the cylinder covers 4 can be adjusted automatically by the fluid pressure therebetween. Simultaneously, the blades 22 are rotating with the rotor 2 and each blade slides freely within a respective slot 21. The grooves 221 provide for lubrication and allow displacement of gas from the slots. This arrangement ensures that each blade 22 will slide freely and expel all of the gas from the compressor chamber portion defined between adjacent blades and the cylinder wall.

As the reservoir 6 is well known by those skilled in the art, its details will not be described herein. The hot mixture of gas and oil from the high pressure valve 61 of reservoir 6 is coupled to appropriate heat exchangers, and from the heat exchangers to the low pressure valve 11 is a basic air conditioner arrangement, which is not the subject matter of this invention, and will not be described herein.

The above described rotary blade air conditioner compressor has the following features:

(1) Each of the blades 22 are disposed radially in the rotor 2, and slide freely within a respective slot 21. This arrangement provides a firm contact between the blades 22 and the wall 10 of the cylinder 1.

(2) The blade members 22 are made from phenolic resin, which provides a better durability and less resistance to displacement than that of an aluminum alloy. The blades 22 are thus able to slide freely within a respective slot 21. Each blade 22 includes a plurality of inclined grooves 221 formed therein, which provides for better lubrication and displacement of gas from the slots 21.

(3) The rotor 2 of the instant invention can freely slide axially on the driving shaft 3, this feature makes the assembly and installation of the compressor of the instant invention quite convenient. If the rotor 2 were fixed to the driving shaft 3, by welding, then the clearance 20 of both sides would be fixed. If one of the bearings 41 failed, the rotor 2 would move, as the driving shaft 3 is displaced in the defective bearing, as the rotor 2 is fixed to the shaft. Whereas, in the instant invention, a lubricating oil/gas mixture is supplied to both sides of the rotor 2. Thus, even if the driving shaft 3 is displaced because of the failure of a bearing 41, the rotor 2 will move to a suitable position on the driving shaft 3, automatically adjusting the clearance 20 on both sides of the rotor, by virtue of the fluid pressure applied thereo.

Although the present invention has been described in connection with the preferred embodiment thereof, many other variations and modifications will now become apparent to those skilled in the art without departing from the scope of the invention. It is preferred therefore that the present invention not be limited by the specific disclosure herein, but only the appended claims.

I claim:

1. A rotary blade air conditioner compressor comprising:

a compressor housing having a cylindrical chamber formed therein, said compressor housing having inlet and outlet openings formed therethrough in fluid communication with said cylindrical chamber;

a pair of chamber covers, each of said pair of chamber covers being coupled to a respective opposing end of said cylindrical chamber;

inlet valve means mounted to said compressor housing in fluid communication with said inlet opening for passage therethrough of a gas;

outlet valve means mounted to said compressor housing in fluid communication with said outlet opening for passage therethrough of a mixture of pressurized gas and oil from said cylindrical chamber;

a reservoir in fluid communication with said outlet valve means and to said inlet valve means, said reservoir having an outlet port at a lower end thereof;

a drive shaft eccentrically mounted in said cylindrical chamber;

a rotor mounted on said drive shaft for rotation therewith, said rotor having an axial through bore formed therein for receiipt of said drive shaft and being axially movable thereon, said rotor having a plurality of radial slots formed therein, said rotor having a channel formed in opposing respective ends of said rotor in open communication with said axial bore of said rotor and said cylindrical chamber;

a plurality of blade members slidably mounted in said radial slots of said rotor, each said blade member being reversibly displaceable within a respective radial slot for continuously contacting an inner peripheral wall of said cylindrical chamber and expelling therefrom said mixture of gas and oil; and, a conduit connected to said outlet port of said reservoir and to each of said chamber covers for simultaneously supplying pressurized gas and oil from said reservoir to each end of said cylindrical chamber and said rotor, whereby said pressurized gas and oil from said reservoir automatically adjusts a clearance space between each of said chamber cover and a respective end of said rotor.

* * * * *